US007884307B2

(12) United States Patent
Li et al.

(10) Patent No.: US 7,884,307 B2
(45) Date of Patent: Feb. 8, 2011

(54) ELECTRIC HEATING TEXTILE

(75) Inventors: Chen-Liang Li, Tu-Chen (TW); Han-Hsing Hsiung, Tu-Chen (TW); Ching-Tang Huang, Tu-Chen (TW); Cheng-Kun Chu, Tu-Chen (TW)

(73) Assignee: Taiwan Textile Research Institute, Tu-Chen, Taipei Hsien (TW)

( * ) Notice: Subject to any disclaimer, the term of this patent is extended or adjusted under 35 U.S.C. 154(b) by 262 days.

(21) Appl. No.: 11/615,616

(22) Filed: Dec. 22, 2006

(65) Prior Publication Data

US 2008/0149620 A1 Jun. 26, 2008

(51) Int. Cl.
*H05B 3/34* (2006.01)
*H05B 11/00* (2006.01)

(52) U.S. Cl. ..... 219/545; 219/211; 219/212; 219/527; 219/528; 219/529; 219/549

(58) Field of Classification Search ..... 219/211–2, 219/217, 527–9, 549, 545
See application file for complete search history.

(56) References Cited

U.S. PATENT DOCUMENTS 4,983,814 A * 1/1991 Ohgushi et al. ..... 219/545
6,656,570 B1 * 12/2003 Fels et al. ..... 428/155

* cited by examiner

*Primary Examiner*—Shawntina Fuqua
(74) *Attorney, Agent, or Firm*—Thomas, Kayden, Horstemeyer & Risley, LLP

(57) ABSTRACT

An electric heating textile is provided. The electric heating textile includes an electric heating layer, plural heat-insulating layers and a protective layer. The electric heating layer includes at least one conductive yarn capable of generating heat and plural aromatic polyamide fibers. The heat-insulating layers are under the electric heating layer. The protective layer is on the electric heating layer. A method for manufacturing the electric heating textile is also disclosed in the specification.

19 Claims, 4 Drawing Sheets

ELECTRIC HEATING TEXTILE

BACKGROUND

1. Field of Invention

The present invention relates to a textile and a manufacturing method thereof. More particularly, the present invention relates to an electric heating textile and a manufacturing method thereof.

2. Description of Related Art

Textile is not only used as clothing material, but also used in other fields. Electric heating textile such as electric blanket is one of the applications of the textile.

In addition to electric blanket, the electric heating textile can be used as an electric heater. Compared to conventional electric heater, the electric heating textile with flexible characteristic can be used as a non-flat surface heater, and is capable of wrapping around an object to be heated when carrying out the heating process. However, due to the structural limitation, the maximum temperature that conventional electric heating textiles can reach is only about 60° C. The application of the conventional electric heating textiles is limited by its low heating temperature. Therefore, it is necessary to develop an electric heating textile capable of providing high temperature performance.

SUMMARY

An electric heating textile is provided. The electric heating textile includes an electric heating layer, plural heat-insulating layers and a protective layer. The electric heating layer includes at least one conductive yarn capable of generating heat and plural aromatic polyamide fibers. The heat-insulating layers are under the electric heating layer. The protective layer is on the electric heating layer.

A method for manufacturing an electric heating textile is provided. First, an electric heating layer including plural aromatic polyamide fibers and at least one conductive yarn capable of generating heat is formed. A protective layer is subsequently sewn on the electric heating layer. Moreover, plural heat-insulating layers are sewn under the electric heating layer.

BRIEF DESCRIPTION OF THE DRAWINGS

These and other features, aspects, and advantages of the present invention will become better understood with regard to the following description, appended claims, and accompanying drawings where:

DETAILED DESCRIPTION

Figure 1A:
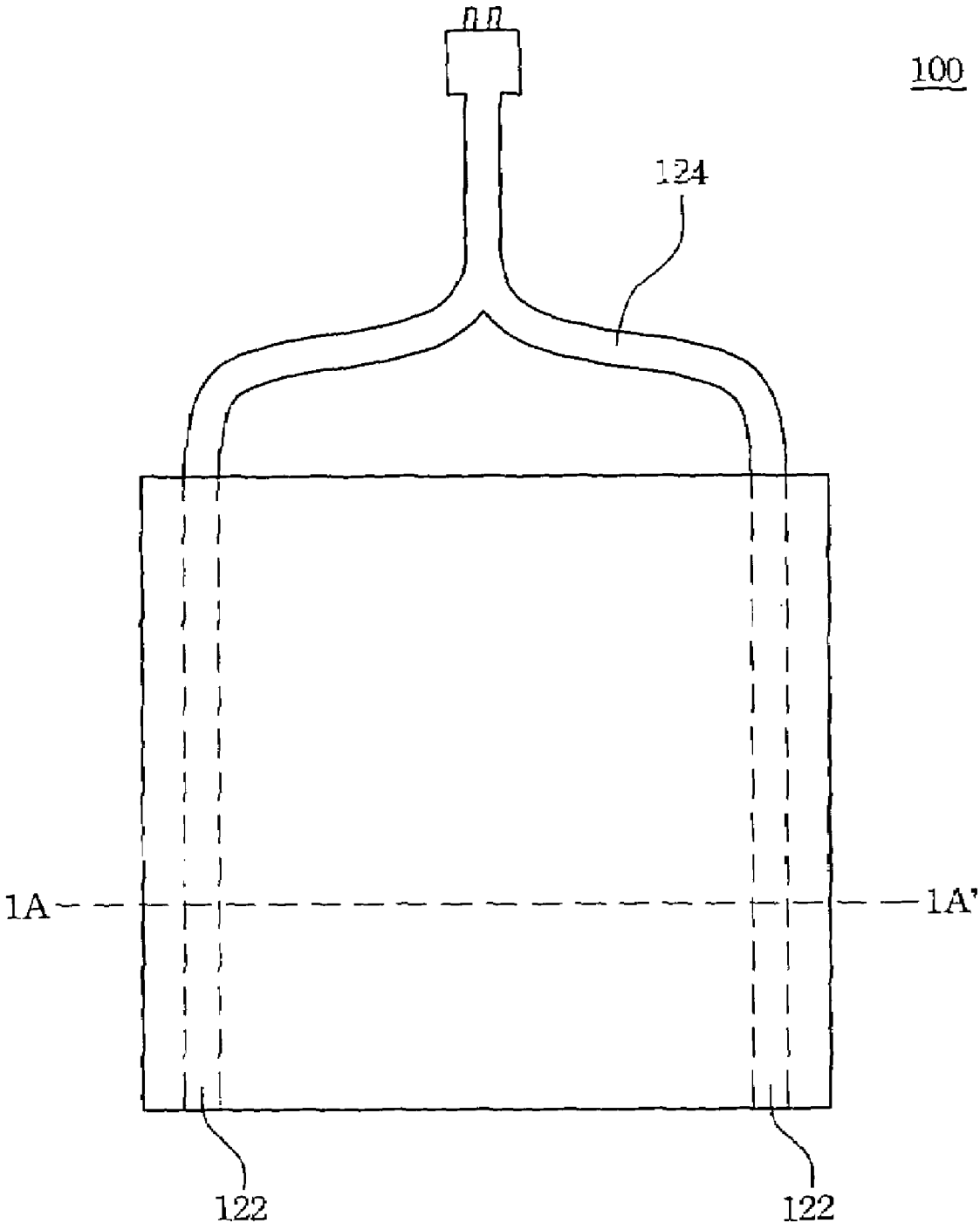
FIG. 1A shows a vertical view of an electric heating textile according to one embodiment of the present invention.
Figure 1B:
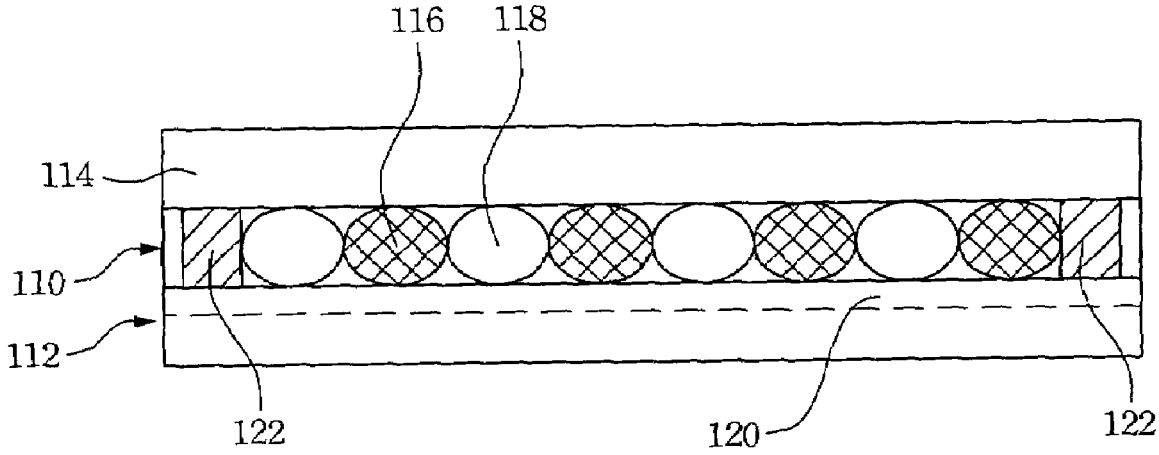
FIG. 1B shows a cross-sectional view along 1A-1A' line in FIG. 1A.

FIG. 1A shows a vertical view of an electric heating textile according to one embodiment of the present invention. FIG. 1B shows a cross-sectional view along 1A-1A' line in FIG. 1A. Referring to FIGS. 1A and 1B, the electric heating textile 100 includes an electric heating layer 110, a heat-insulating layer 112 and a protective layer 114. The electric heating layer 110 includes at least one conductive yarn 116 capable of generating heat and plural aromatic polyamide fibers 118. The heat-insulating layer 112 is under the electric heating layer 110. The protective layer 114 is on the electric heating layer 110.

Referring to the FIGS. 1A and 1B, the edge of the electric heating layer 110 further includes plural electrodes 122 capable of connecting the conductive yarn 116 with an external wires 124. The electrode 122 can be a metal sheet and further be sewn on the edge of the electric heating layer 110 by machine sewing. Besides, the electrode 122 also can be a conductive fiber, and further be connected to the conductive yarn 116 by weaving method.

A method for manufacturing the electric heating textile 100 is disclosed in the embodiment of the present invention. The electric heating layer 110 including the conductive yarn 116 and the aromatic polyamide fiber 118 is formed first. Then the protective layer 114 and the heat-insulating layer 112 are sewn on and under the electric heating layer 110 respectively.

Figure 1C:
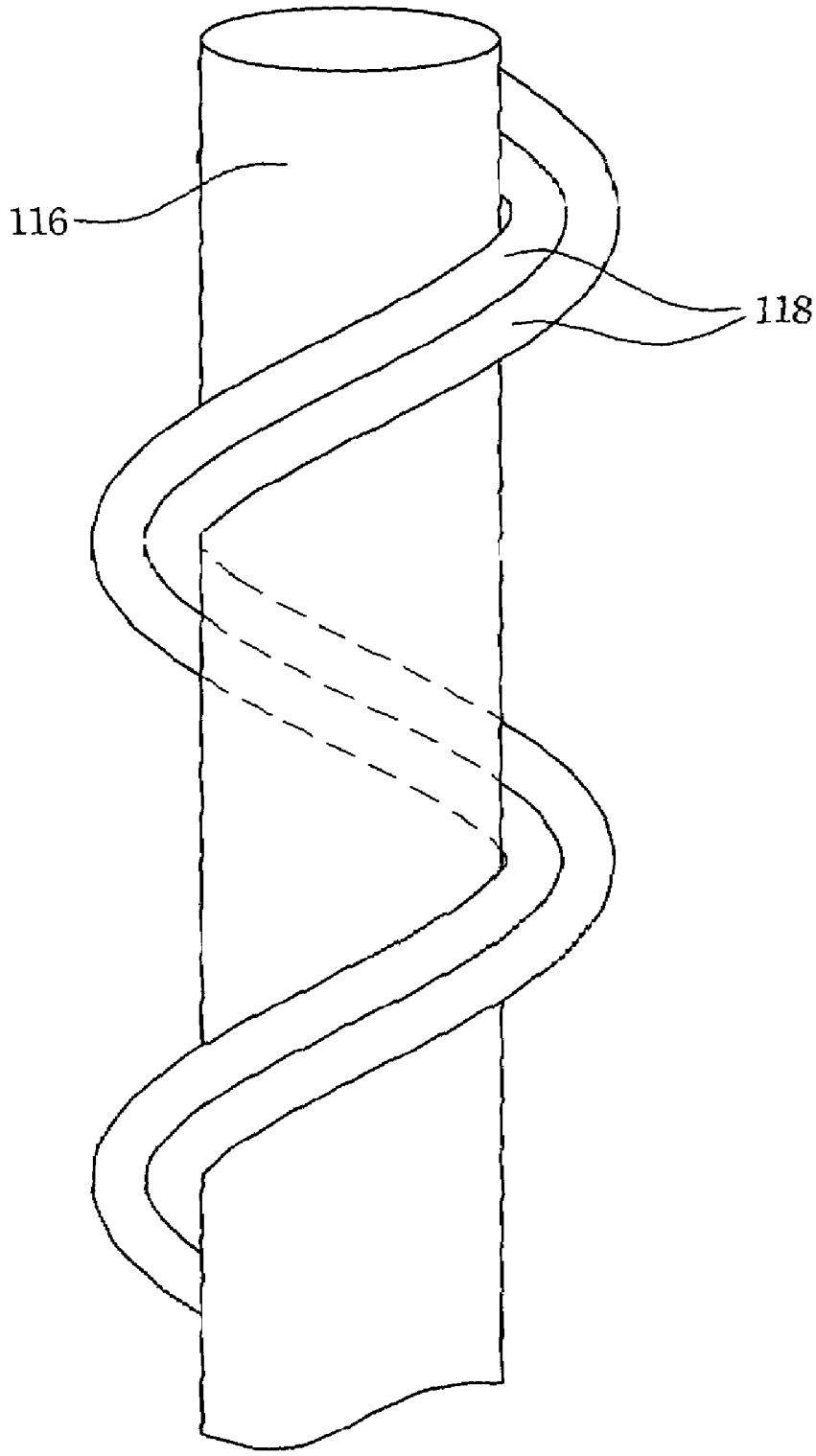
FIG. 1C shows a conductive yarn wrapped around with aromatic polyamide fiber according to one embodiment of the present invention.

Referring to FIG. 1B, the electric heating layer 110 can be an interlaced structure consisting of the conductive yarn 116 and the aromatic polyamide fiber 118. The electric heating layer 110 can be formed by knitting or woven method. In addition to the forming method of the electric heating layer 110 given above, another method is also provided. First, a fabric consisting of aromatic polyamide fiber 118 is formed. Then the conductive yarn 116 is formed on/in the fabric by laid in method, machine sewing, embroidery method or weaving method. Besides, referring to the FIG. 1C, the electric heating layer 110 can also be woven by the conductive yarn 116 wrapped around with the aromatic polyamide fibers 118.

The aromatic polyamide fiber 118 given above at least can resist temperature up to 400° C. and can also resist temperature generated by the conductive yarn 116. Therefore, the temperature generated by the electric heating layer 110 can be increased, and it further increases the heating temperature of the electric heating textile 100. The aromatic polyamide fiber 118 can be poly(m-phenylene isophthalamide) (e.g. Nomex fiber), poly(p-phenylene terephthalamide) (e.g. Kevlar fiber), or co-poly(para phenylene/3,4'-oxydiphenylene terephthalamide) (e.g. Technora fiber).

The conductive yarn 116 can be metal fiber, alloy fiber or carbon fiber. The diameter of the metal fiber and the alloy fiber is about 1~1000 micrometer. The denier number of the carbon fiber is about 6000~12000 denier.

Referring to FIG. 1B, the protective layer 114 on the electric heating layer 110 is capable of preventing the electric heating layer 110 from being in contact with environment. Besides, the protective layer 114 can be a waterproof, rub-resistant, heat-resistant and moisture permeable layer. The protective layer 114 can be an aromatic polyamide fiber layer or an oxidized fiber layer, and be sewn on the electric heating layer 110 by machine sewing or hand sewing.

The heat-insulating layer 112 also can be sewn under the electric heating layer 110 by machine sewing or hand sewing. The heat-insulating layer includes at least one high-temperature-resisting fiber layer 120 adjacent to the electric heating layer 110. The high-temperature-resisting fiber layer 120 can be the oxidized fiber layer, the aromatic polyamide fiber layer, a ceramic fiber layer or a combination thereof. The high-temperature-resisting fiber layer 120 at least can resist temperature up to 400° C. and insulate heat transferred from the electric heating layer 110. Due to the heat insulating effect of the high-temperature-resisting fiber layer 120, the temperature of a surface, opposite to the electric heating layer 110, of the high-temperature-resisting fiber layer 120 is greatly lowered. Materials with low cost and low heat-resistance, such as nylon fiber layer, natural fiber layer, polyethylene terephthalate layer or a combination thereof, can further be located under the high-temperature-resisting fiber layer 120 to achieve heat insulation and low manufacturing cost.

The heat-insulating layer 112 given above can prevent heat from being transferring downward to enable the electric heating textile 100 to have one way heating characteristic. For example, this allows the temperature of the bottom of the heat-insulating layer 112 to be only about 50° C. when the temperature of the top of the protective layer 114 reaches 300° C.

Figure 2:
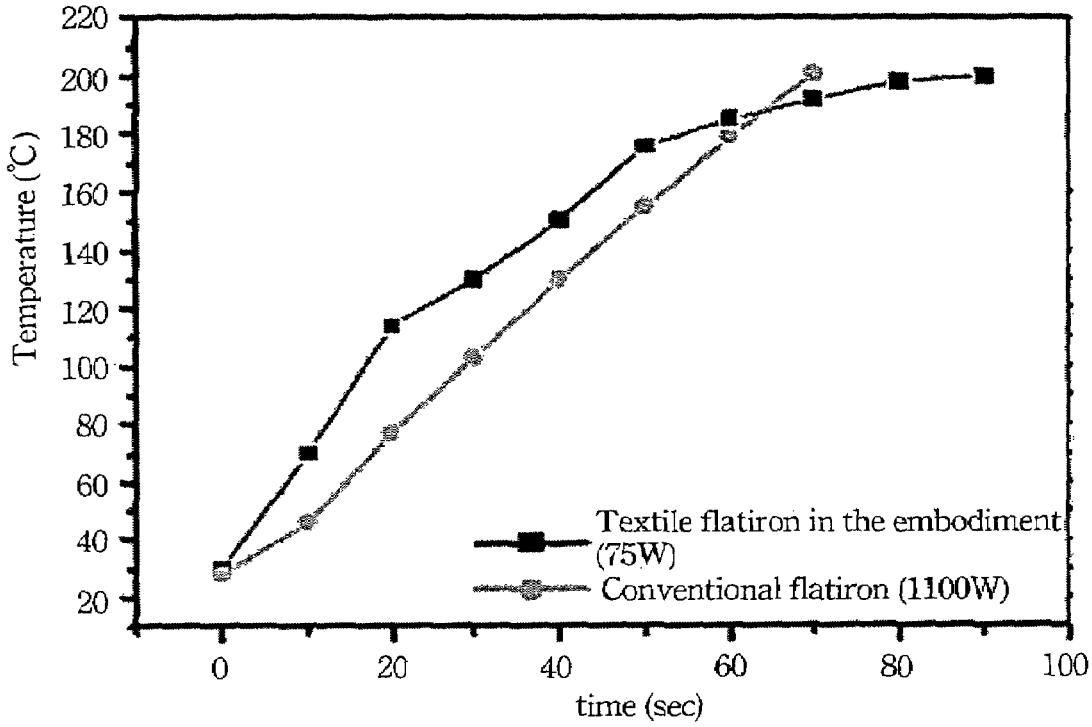
FIG. 2 shows the heating curves of a conventional flatiron and the textile flatiron in the embodiment of the present invention.
Figure 3:
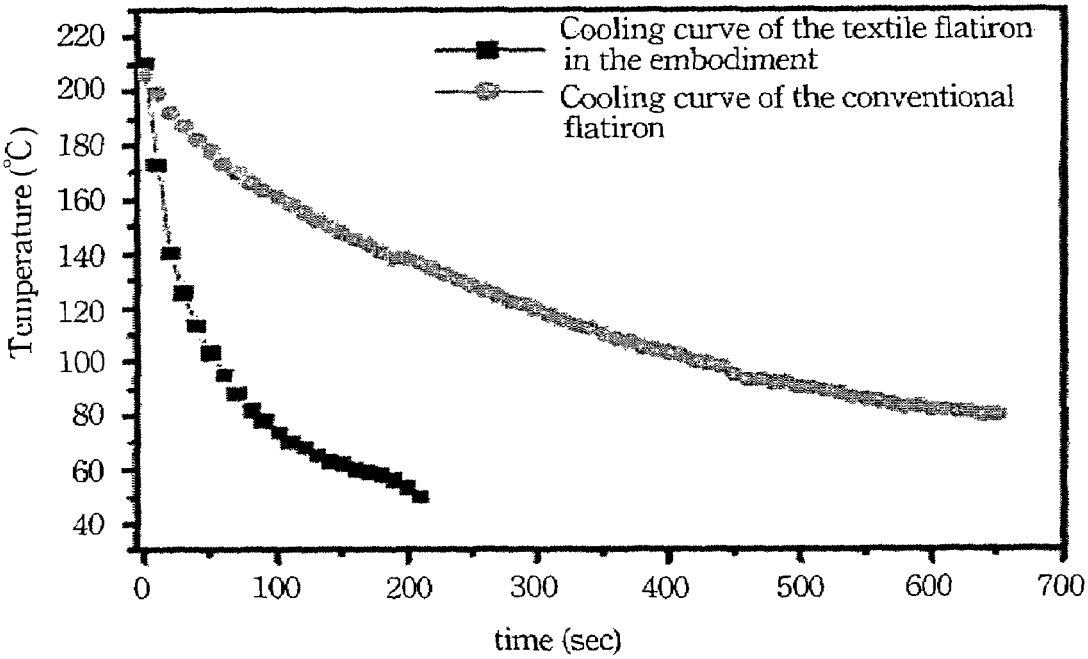
FIG. 3 shows the cooling curves of a conventional flatiron and the textile flatiron in the embodiment of the present invention.

Except for being a heater, the electric heating textile 100 given above can be a textile flatiron. The surface of the protective layer 114 can be a heating surface of the textile flatiron. FIG. 2 shows the heating curves of a conventional flatiron and the textile flatiron in the embodiment of the present invention. FIG. 3 shows the cooling curves of a conventional flatiron and the textile flatiron in the embodiment of the present invention. Referring to FIG. 2, the textile flatiron according to the embodiment of the present invention can provide temperature up to 100~180° C. more quickly than a conventional flatiron. Referring to FIG. 3, the textile flatiron according to the embodiment of present invention can be cooled down more quickly than a conventional flatiron. The higher cooling rate of the textile flatiron given above can reduce the probability of accident happened in the cooling process of a conventional flatiron.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A method for manufacturing an electric heating textile, comprising:

forming an electric heating layer, wherein the electric heating layer comprises a plurality of aromatic polyamide fibers and at least one conductive yarn capable of generating heat;

sewing a plurality of heat-insulating layer under the electric heating layer; and sewing a protective layer on the electric heating layer.

2. The electric heating textile manufacturing method of claim 1, wherein the aromatic polyamide fibers are interlaced with the conductive yarn to form the electric heating layer.

3. The electric heating textile manufacturing method of claim 1, wherein the forming method of the electric heating layer comprises:

forming a fabric with the aromatic polyamide fiber; and forming the conductive yarn on/in the fabric by laid in method, machine sewing, embroidery method or weaving method.

4. The electric heating textile manufacturing method of claim 1, wherein the conductive yarn is wrapped around with the aromatic polyamide fibers, and further woven to form the electric heating layer.

5. The electric heating textile manufacturing method of claim 2, wherein the interlaced structure consisting of the conductive yarn and the aromatic polyamide fibers is formed by knitting or woven method.

6. The electric heating textile manufacturing method of claim 1, wherein the sewing method of the heat-insulating layer is machine sewing or hand sewing.

7. The electric heating textile manufacturing method of claim 1, wherein the sewing method of the protective layer is machine sewing or hand sewing.

8. The electric heating textile manufacturing method of claim 1, further comprising forming a plurality of electrodes on the edge of the heat-insulating layer.

9. The electric heating textile manufacturing method of claim 8, wherein the electrodes are conductive fiber and connected to the conductive yarn by weaving method.

10. The electric heating textile manufacturing method of claim 8, wherein the electrodes are metal sheet sewn on the edge of the electric heating layer by machine sewing.

11. The electric heating textile manufacturing method of claim 1, wherein the aromatic polyamide fibers are selected from a group consisting of poly(m-phenylene isophthalamide), poly(p-phenylene terephthalamide), and co-poly(para phenylene/3,4'-oxydiphenylene terephthalamide).

12. The electric heating textile manufacturing method of claim 1, wherein the conductive yarn is selected from a group consisting of a metal fiber, an alloy fiber and a carbon fiber.

13. The electric heating textile manufacturing method of claim 12, wherein the diameter of the metal fiber is about 1~1000 micrometer.

14. The electric heating textile manufacturing method of claim 12, wherein the diameter of the alloy fiber is about 1~1000 micrometer.

15. The electric heating textile manufacturing method of claim 12, wherein the denier number of the carbon fiber is about 6000~12000 denier.

16. The electric heating textile manufacturing method of claim 1, wherein the heat-insulating layers comprises at least one high-temperature-resisting fiber layer adjacent to the electric heating layer.

17. The electric heating textile manufacturing method of claim 16, wherein the high-temperature-resisting fiber layer is selected from a group consisting of an oxidized fiber layer, an aromatic polyamide fiber layer, a ceramic fiber layer and a combination thereof.

18. The electric heating textile manufacturing method of claim 16, wherein the area under the high-temperature-resisting fiber layer is at least one nylon fiber layer, at least one natural fiber layer, at least one polyethylene terephthalate layer or a combination thereof.

19. The electric heating textile manufacturing method of claim 1, wherein the protective layer is an aromatic polyamide fiber layer or an oxidized fiber layer.

* * * * *